US008215403B1

(12) United States Patent
Penisson

(10) Patent No.: US 8,215,403 B1
(45) Date of Patent: Jul. 10, 2012

(54) DOWNHOLE CIRCULATING TOOL AND METHOD OF USE

(75) Inventor: Dennis J. Penisson, Raceland, LA (US)

(73) Assignee: Wellbore Specialties, LLC, Lockport, LA (US)

( * ) Notice: Subject to any disclaimer, the term of this patent is extended or adjusted under 35 U.S.C. 154(b) by 754 days.

(21) Appl. No.: 12/191,528

(22) Filed: Aug. 14, 2008

(51) Int. Cl.
*E21B 43/00* (2006.01)

(52) U.S. Cl. ..... 166/331; 166/321; 166/386; 166/387

(58) Field of Classification Search ..... 166/331, 166/153, 332.1, 374, 319, 320, 240, 386; 175/232–243
See application file for complete search history.

(56) References Cited

U.S. PATENT DOCUMENTS

| | | | | |
|---|---|---|---|---|
| 5,609,178 | A * | 3/1997 | Hennig et al. | 137/10 |
| 6,102,060 | A * | 8/2000 | Howlett et al. | 137/1 |
| 7,527,104 | B2 * | 5/2009 | Branch et al. | 166/331 |
| 2004/0129423 | A1 * | 7/2004 | Eddison | 166/321 |
| 2007/0181313 | A1 * | 8/2007 | Churchill | 166/374 |

OTHER PUBLICATIONS

Downhole Devices, LLC, Printout of Web Page Located at http://www.downholedevices.com/products.htm (last visited May 7, 2009), page includes copyright notice dated 2006.
Drilling Systems International, Various Brochures and Technical Documents available at http://www.dsi-pbl.com/downloads/downloads.php (last visited May 7, 2009), date of publication unknown.
Drilling Systems International, "PBL Operation Sequence", Jan. 2006.
Drilling Systems International, Various Technical Specification Sheets available at http://www.dsi-pbl.com/technical_drawings/technical_drawings.php (last visited May 7, 2009), date of publication unknown.

* cited by examiner

*Primary Examiner* — Kenneth L Thompson
*Assistant Examiner* — Yong-Suk Ro
(74) *Attorney, Agent, or Firm* — Raymond G. Areaux; Ian C. Barras; Carver, Darden, Koretzky, Tessier, Finn, Blossman & Areaux, LLC

(57) ABSTRACT

A downhole circulating tool including a sleeve with a cam slot having continuous and symmetrical wishbone patterns through which a cam pin moves. The cam pin moves simultaneously through symmetrical portions of the cam slot to alternate the opening and closing of first and second fluid port openings. A first port opening is operable to communicate fluid to a drill bit when open. A second port opening is operable to communicate fluid directly into the borehole or casing wall of a wellbore when open.

15 Claims, 12 Drawing Sheets

DOWNHOLE CIRCULATING TOOL AND METHOD OF USE

BACKGROUND OF THE INVENTION

1. Field of the Invention

The present invention relates to drilling in the oil field industry and more particularly to a downhole circulating tool with a cam slot having continuous and symmetrical wishbone patterns through which a cam pin moves to alternate fluid port openings.

2. General Background

Drilling fluid is pumped down through a circulating tool to a drill bit. The fluid returns to the surface through the annulus defined between the string and the borehole wall or bore-lining casing. However, the drill cuttings may settle in the bore if the flow rate of the returning fluid is not sufficiently high. The circulating tool circulates the fluid in the borehole annulus to facilitate removal of drill cuttings which have settled in the borehole. Moreover, the circulating tool improves removal of caked drilling fluid, cement and debris from the drilled casing plugs, most of which may be attached to the casing wall of a borehole.

Known circulating tools have sliding tubes (sometimes in multiples) with seals (e.g. soft seals). Seals are a concern of any circulating tool. The circulating tools may operate under high pressures (up to 3000 PSI) and high flow rates (e.g. 10-20 barrels per minute or more). Thus, a seal failure can be a disaster. A seal failure can not only disable the function of the tool but also damage the tool with washouts.

Some tools use a cam with an unequal pin travel. Others have many seals needed for the tool to work which require manufacturing precision and a restriction to make the tool shift.

Thus, there is a need for techniques to improve the circulation of the drilling fluid to facilitate the removal of settled drill cuttings and/or borehole debris.

SUMMARY OF THE PRESENT INVENTION

The present invention contemplates a downhole circulating tool with a cam slot having continuous and symmetrical wishbone patterns through which a cam pin moves to alternate fluid port openings.

The present invention provides in one configuration a downhole circulating tool comprising a cam slot having continuous and symmetrical wishbone patterns through which a cam pin moves. The tool includes first and second fluid port openings, and a sealing ball coupled to the cam pin to alternate opening and closing of the first and second fluid port openings as the cam pin travels in the cam slot.

The present invention includes a downhole circulating tool comprising a main tubular structure operable to be coupled to a work string and a sleeve concentric within and affixed to the main tubular structure, said sleeve including a cam slot. The tool also includes dual-port openings, a first port opening passes fluid through a portion of the work string below the dual-port openings and a second port opening passes fluid into a borehole, and a rotating assembly having a through-bore for communication of the fluid to the dual port openings, a cam pin and a sealing ball operable to be alternately seated in and to selectively close a respective one of the first and second port openings, as the rotating assembly rotates as the cam pin travels a symmetric cam slot.

A further aspect of the present invention includes a downhole circulating tool with a spring biased value to selectively open and close an opening to a lower drill bit.

In view of the above, a feature of the circulating tool is a simple, loose construction.

A further feature of the circulating tool is that the tool has the ability to pass fluid at higher flow rates than known circulating tools.

A still further feature of the circulating tool is that the tool has the ability to shift as many times as needed.

A still further feature of the circulating tool is that the tool has a full opening to reverse flow.

A still further feature of the circulating tool is that no shear pins are needed.

A still further feature of the circulating tool is that the tool has no contact with liners or downhole restrictions to shift the tool.

The above and other objects and features of the present invention will become apparent from the drawings, the description given herein, and the appended claims.

BRIEF DESCRIPTION OF THE DRAWING

For a further understanding of the nature and objects of the present invention, reference should be had to the following description taken in conjunction with the accompanying drawings in which like parts are given like reference numerals.

Figure 1A:
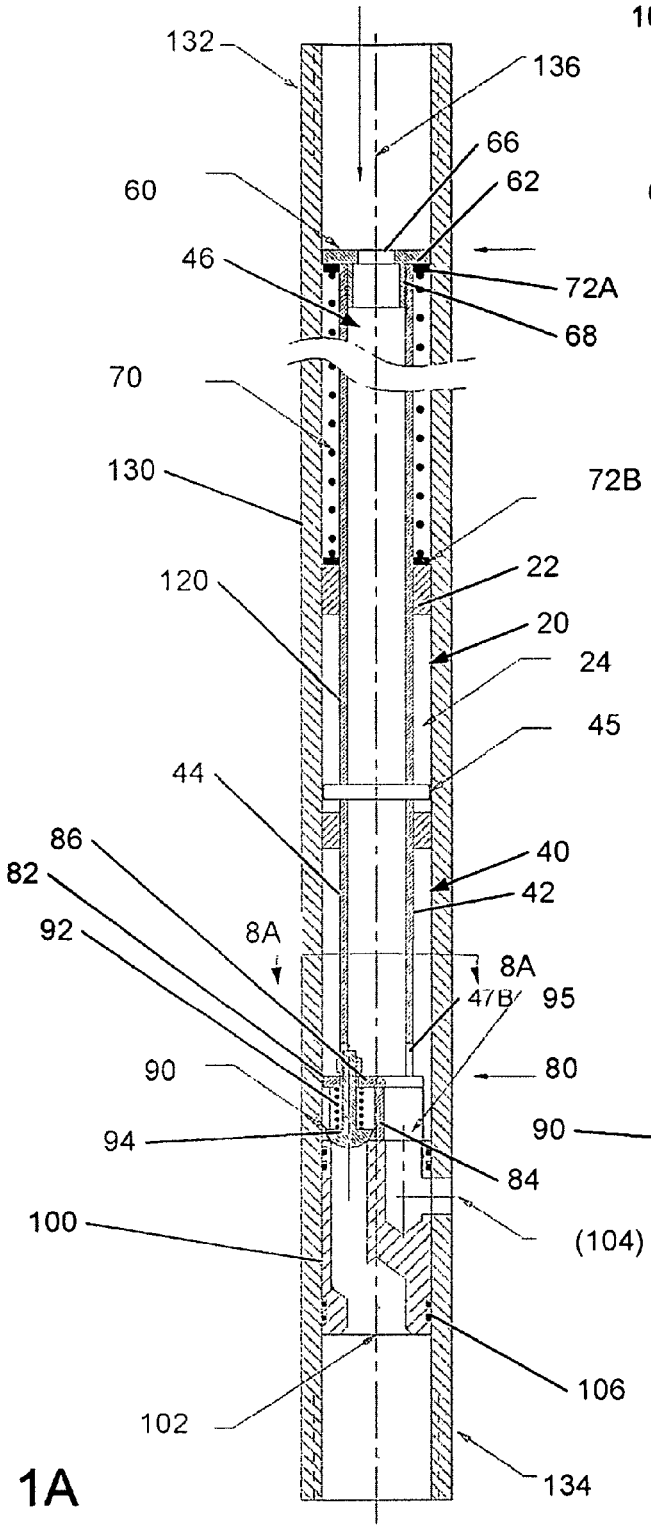
FIG. 1A illustrates a partial cross sectional view of the downhole circulating tool in accordance with the present invention with a valve plunger in a first position.

The appended drawings illustrate exemplary configurations of the invention and, as such, should not be considered as limiting the scope of the invention that may admit to other equally effective configurations. It is contemplated that features or steps of one configuration may be beneficially incorporated in other configurations without further recitation.

DETAILED DESCRIPTION

The word "exemplary" is used herein to mean "serving as an example, instance, or illustration." Any configuration or design described herein as "exemplary" is not necessarily to be construed as preferred or advantageous over other configurations or designs.

Referring now to the drawings and in particular FIGS. 1A-1C and 3-6, the circulating tool of the present invention is generally referenced by the numeral 10. The circulating tool 10 includes, in general, a first tool subassembly 20, a second tool subassembly 40, a top piston assembly 60, a lower seat 80 with a spring loaded valve 90 and a double-port connector 100, which all together form a dual-port opening and closing mechanism 120.

The circulating tool 10 further includes an elongated outer sleeve 130 having a top box (threaded) connection 132 and a bottom box (threaded) connection 134. The elongated outer sleeve 130 has a hollow through-bore 136 in which to isolate the dual-port opening and closing mechanism 120 from the liner or casing wall.

The tool 10 further comprises a top connector 140 and a bottom connector 142 adapted to be coupled to the top box (threaded) connection 132 and the bottom box (threaded) connection 134. The top connector 140 attaches the tool 10 to a portion of a work string that is above the tool 10. Likewise, the bottom connector 142 attaches the tool 10 to a portion of the work string below the tool 10. A space 71 is created between the top of dual-port opening and closing mechanism 120 and the top connector 140. Likewise, a space 74 is created between the bottom of dual-port opening and closing mechanism 120 and the bottom connector 142. The centers of the top and bottom connectors 140 and 142 have through-bores for the passage of fluid into and out of the tool 10.

As will be seen from the description, the circulating tool 10 is constructed and arranged to have no tube seals and is loosely fitted (sloppily fitted).

As best seen in FIGS. 1A-1C, 2A-2C and 3, the first tool subassembly 20 includes a tubular shaped structure 22 with a hollow through-bore 26. The tubular shaped structure 22 has formed therein a cam slot 24. The cam slot 24 varies circumferentially around the tubular shaped structure 22. The tubular shaped structure 22 is adapted to be fastened or coupled to the elongated outer sleeve 130 so that the first tool subassembly 20 is in fixed relationship with the elongated outer sleeve 130, as will be described later in relation to FIG. 9.

The cam slot 24 has four angularly-slanted patterns joined together through which a cam pin 45 moves. The angularly-slanted patterns of the cam slot 24 create two upper notches A1 and A2 and two lower notches A3 and A4. In operation, the cam pin 45 does not reach the upper most apexes of either of notches A1 and A2 or the lower most apexes of either of notches A3 and A4 to prevent damage to the cam pin 45. As will be seen for the description later, the sealing ball (valve plunger 94) is automatically rotated 180° as the cam pin 45 moves or travels from a lower notch to an adjacent upper notch A1 or A2 and then down once in the next adjacent lower notch A3 or A4. The cam pin 45 is not impacted anywhere in the cam slot 24.

The four angularly-slanted patterns form two wishbone patterns W1 and W2 which share either two upper notches or two lower notches. In one aspect, each wishbone pattern W1 or W2 of the cam slot 24 is symmetrical. For example, the wishbone pattern W2 may include upper notch A1 followed by adjacent lower notch A3 which in turn is followed by upper notch A2. The wishbone pattern W1 may include upper notch A2 followed by lower notch A4 which in turn is followed by upper notch A1. The cam pattern 24 is symmetrical at 90° increments and 180° around the circumference of the tubular shaped structure 22.

The upper notch A1 and lower notch A3 are displaced by approximately 90° around the tubular shaped structure 22. The upper notch A1 and upper notch A2 are displaced approximately by 180° from each other around the tubular shaped structure 22. Likewise, the two lower notches A3 and A4 are displaced approximately by 180° from each other around the tubular shaped structure 22. The wishbone patterns W1 and W2 have a quasi V-shape. In the exemplary embodiment, the shape of the cam pattern 24 allows movement in only 1 circumferential direction (in other words, the cam pin 45 can only travel in a clockwise or counterclockwise direction—it cannot oscillate).

As will be seen from the description below, the cam slot 24 has a continuous and symmetrical wishbone patterns through which a cam pin 45 moves to alternate fluid port openings between a path downhole such as to a drill bit (not shown) or out of the elongated outer sleeve 130 and into the borehole, as will be described in more detail below.

Figure 1B:
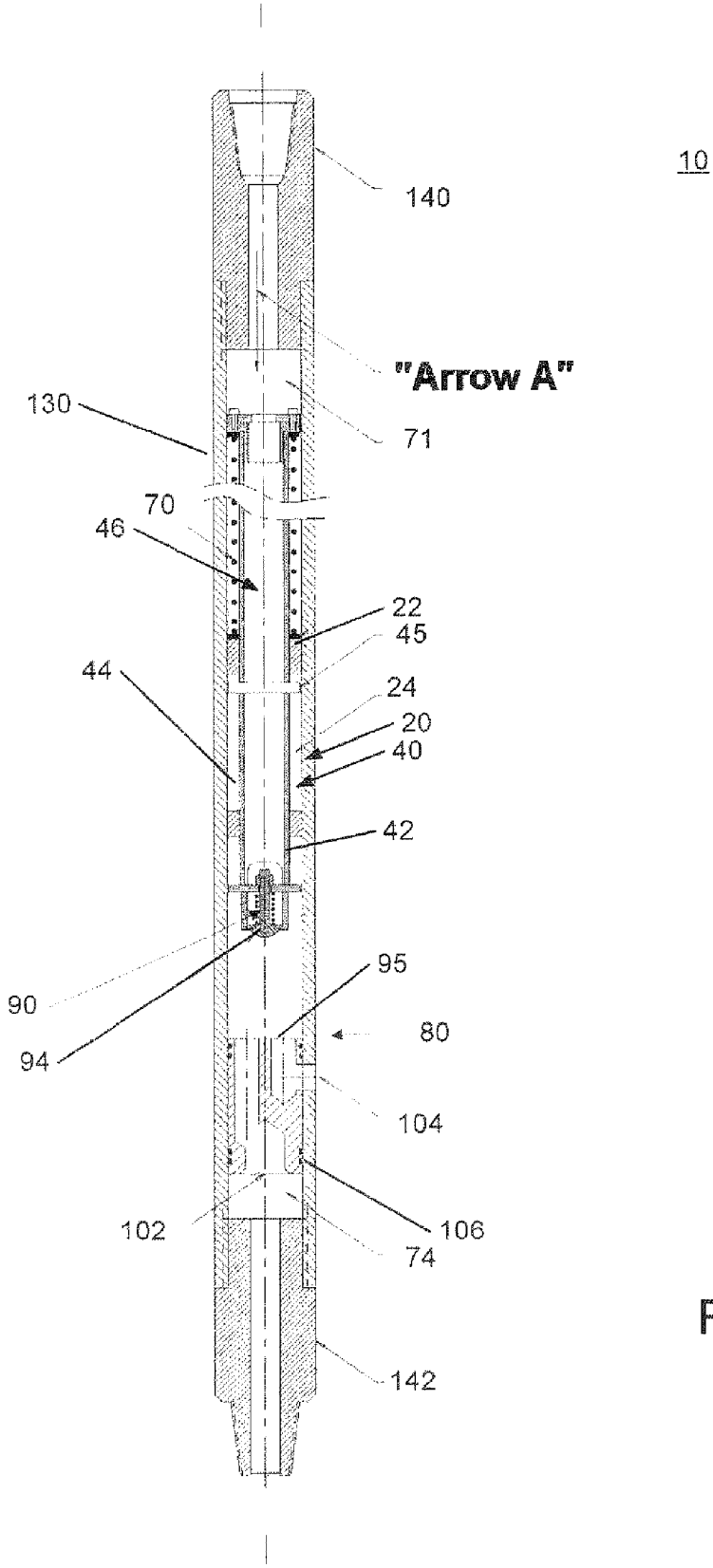
FIG. 1B illustrates a partial cross sectional view of the downhole circulating tool in accordance with the present invention with the valve plunger in a second position and with top and bottom connectors.
Figure 2A:
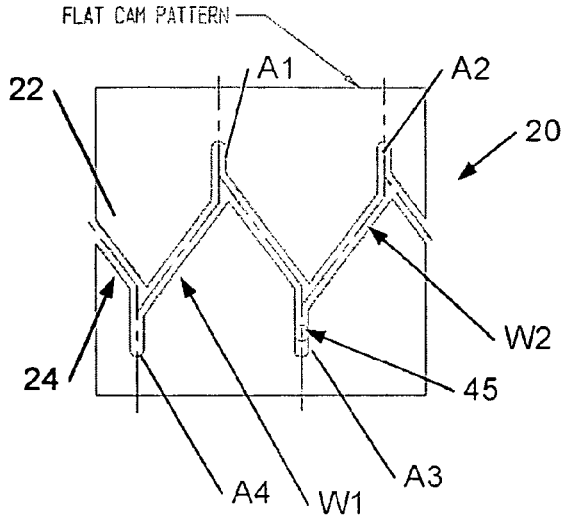
FIG. 2A illustrates a first tool subassembly laid flat to display a cam pattern with a cam pin in a first position.
Figure 2B:
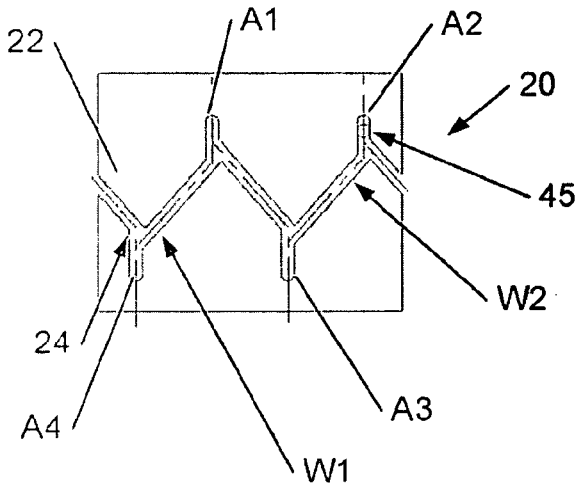
FIG. 2B illustrates a first tool subassembly laid flat to display a cam pattern with a cam pin in a second position.

FIG. 2A illustrates the first tool subassembly 20 laid flat to display the cam slot 24 with the cam pin 45 in a first position corresponding to notch A3. In one configuration, the first position corresponds to the closing of a first port 102, as best seen in FIG. 1A. FIG. 2B illustrates the first tool subassembly 20 laid flat to display the cam slot 24 with the cam pin 45 in a second position corresponding to notch A2. In one configuration, the second position corresponds to the opening of both ports 102 and 104, as best seen in FIG. 1B, by virtue of the lifting of the sealing ball (valve plunger 94).

Figure 8A:
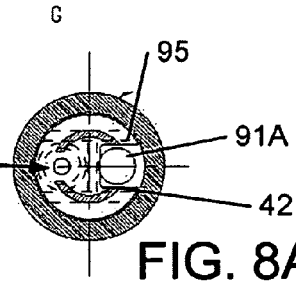
FIG. 8A illustrates a cross-sectional view along the plane 8A-8A of FIG. 1A.
Figures 1C, 8B:
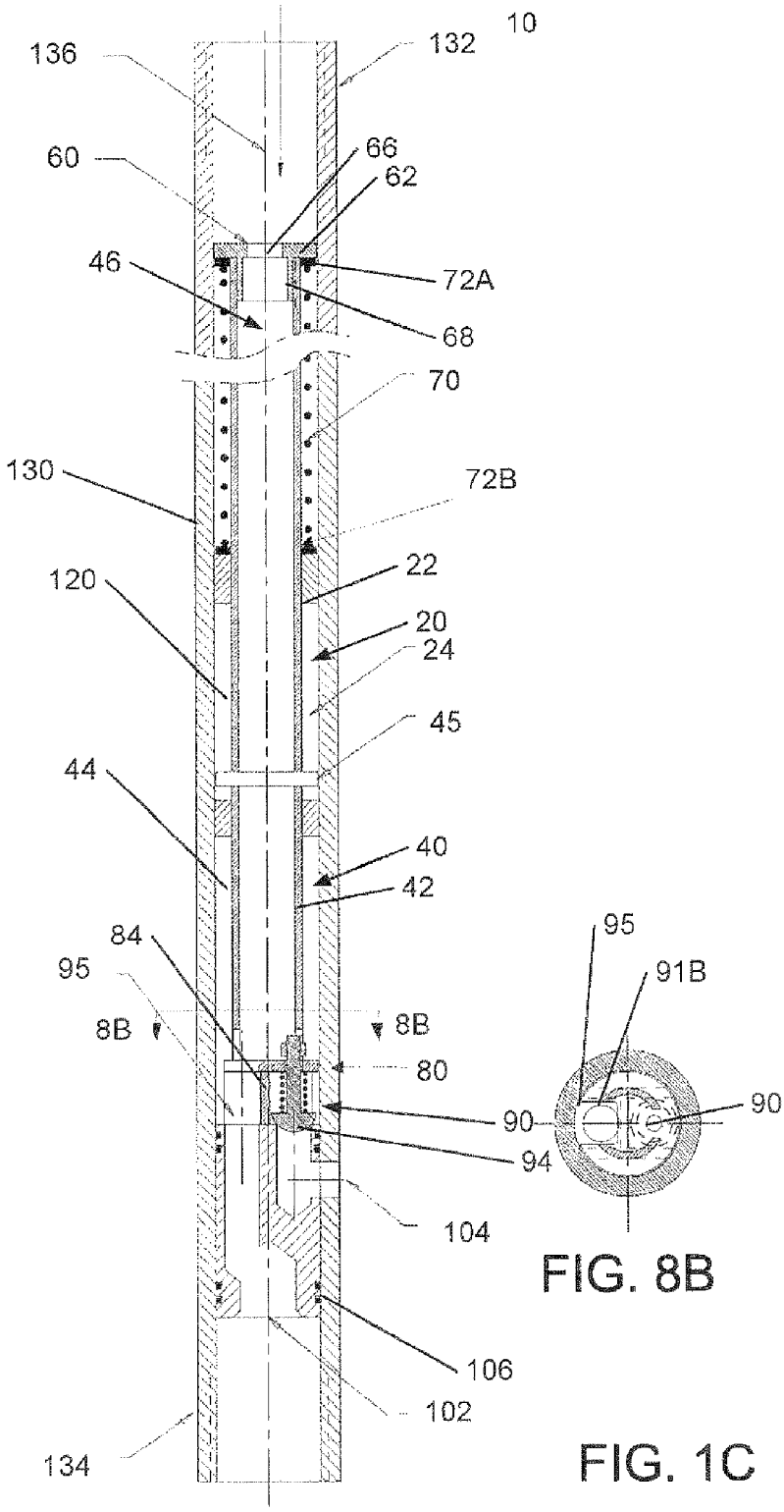
FIG. 1C illustrates a partial cross sectional view of the downhole circulating tool in accordance with the present invention with the valve plunger in a third position.
FIG. 8B illustrates a cross-sectional view along the plane 8B-8B of FIG. 1C.
Figure 2C:
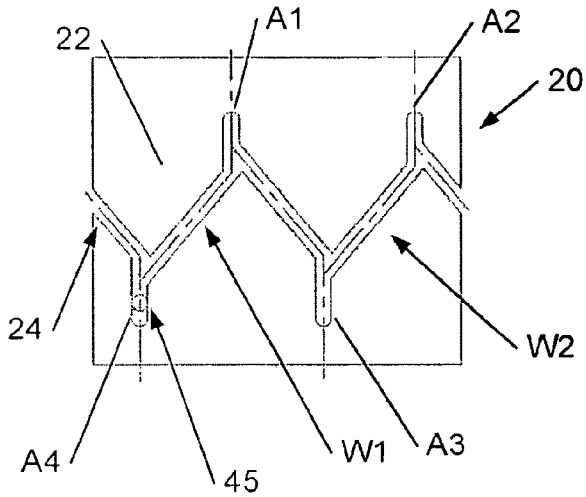
FIG. 2C illustrates a first tool subassembly laid flat to display a cam pattern with a cam pin in a third position.
Figure 3:
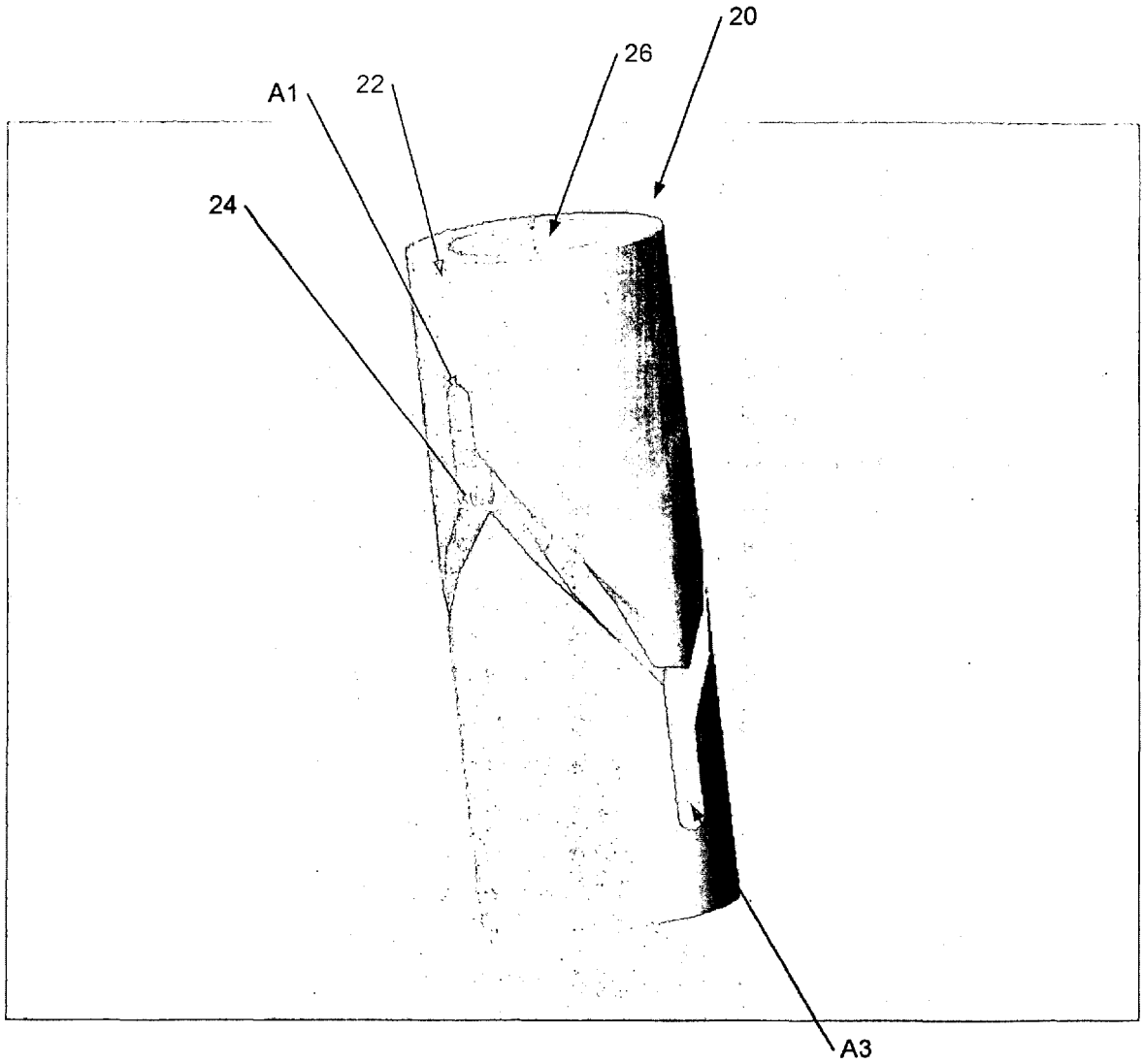
FIG. 3 illustrates a perspective view of the first tool subassembly.
Figure 4:
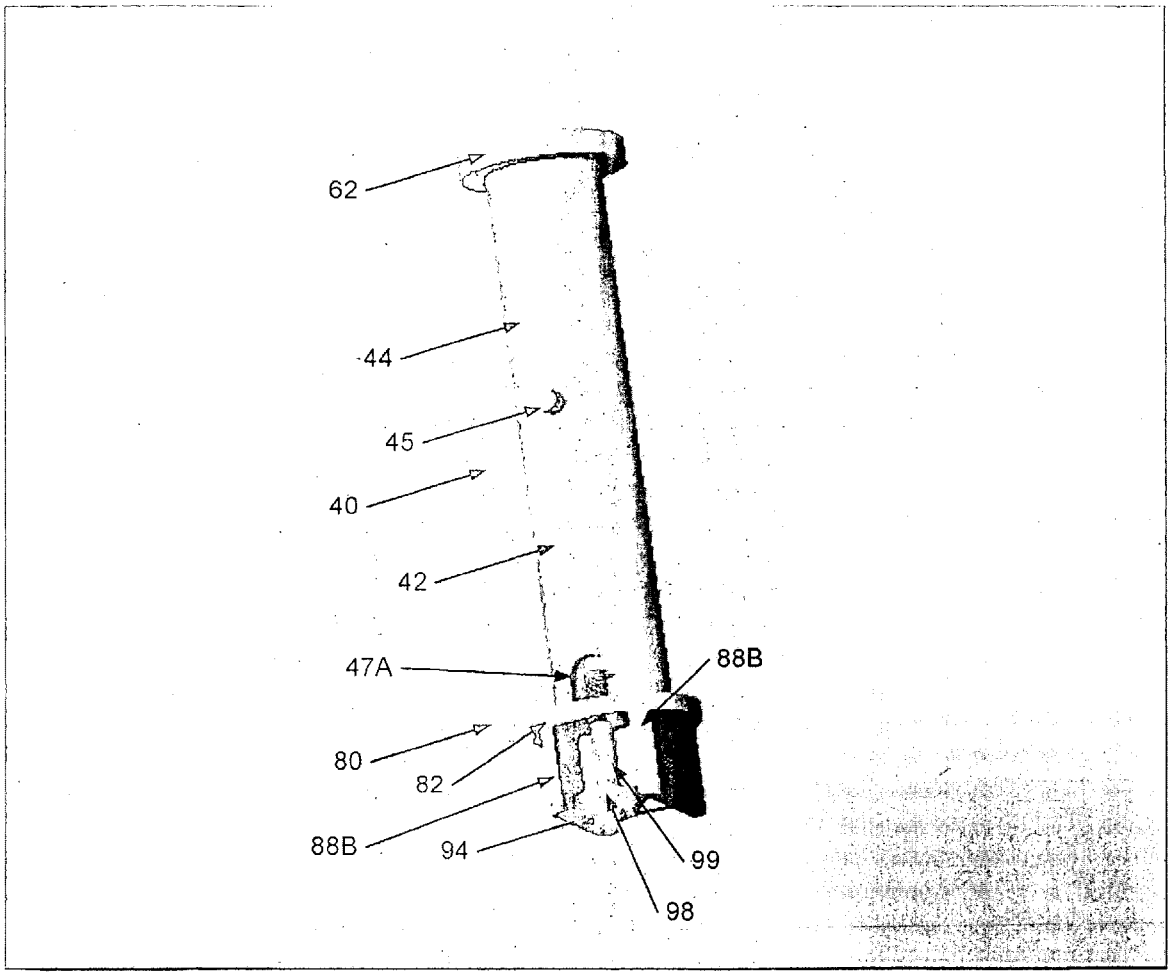
FIG. 4 illustrates a perspective view of a second tool subassembly with a spring loaded valve in an open position.
Figure 5:
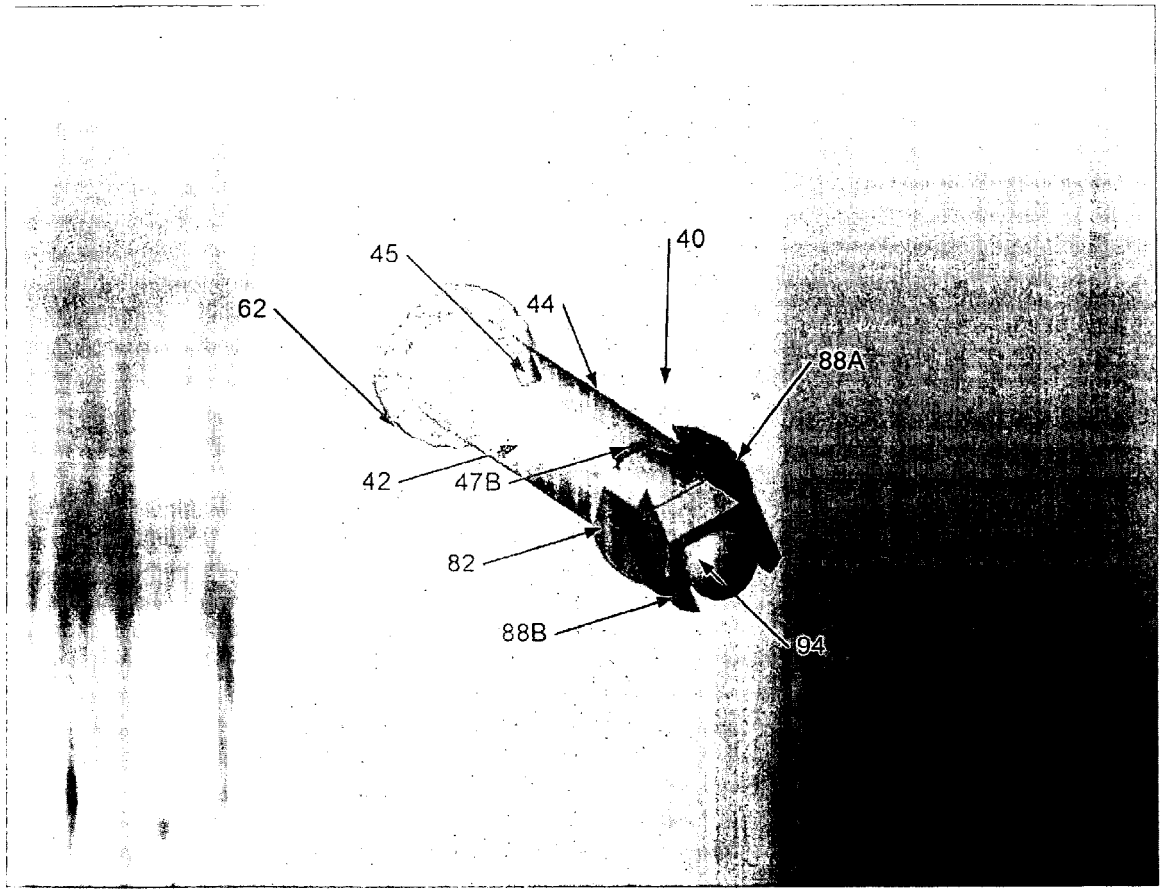
FIG. 5 illustrates a perspective end view of the second tool subassembly.
Figure 6:
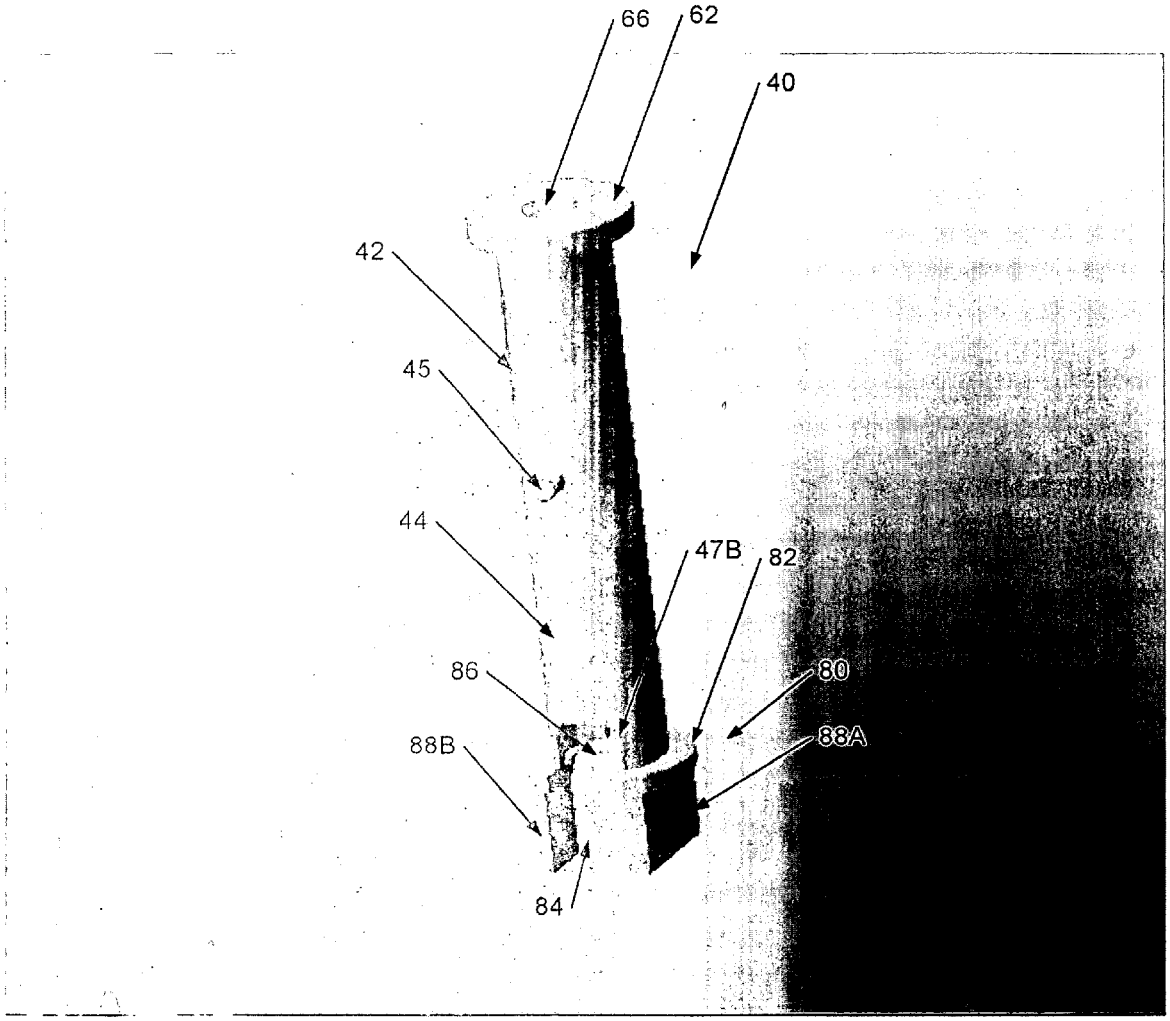
FIG. 6 illustrates a perspective view of the second tool subassembly with the spring loaded valve removed.

FIG. 2C illustrates the first tool subassembly 20 laid flat to display the cam slot 24 with the cam pin 45 in a third position corresponding to notch A4. In one configuration, the third position corresponds to the closing of a second port 104, as best seen in FIG. 1C. In one configuration, a center axis of an output port of the first port 102 is perpendicular to a center axis of an output port of the second port 104. Furthermore, traveling one complete wishbone pattern will close the first port 102, open the first port 102 (while the second port remains open) and close the second port 102 (while the first port remains open).

Referring now to FIGS. 1A-1C, 2A-2C and 4-6, the circulating tool 10 further includes a second tool subassembly 40 serving as a main body 42 of the circulating tool 10. The first tool subassembly 20 is constructed and arranged to be a sleeve which is concentric to and positioned around the main body 42. The second tool subassembly 40 has a main tubular shaped structure 44 having a hollow through-bore 46 axially aligned with the hollow through-bore 26 and through-bore 136. The main tubular shaped structure 44 has projecting or protruding therefrom a cam pin 45. The cam pin 45 extends diametrically through main tubular shaped structure 44 and the tubular shaped structure 22 (sleeve). The longitudinal axis of the cam pin 45 is arranged to be perpendicular to the longitudinal axis of the tool 10. The cam pin 45 extends simultaneously in notches A1 and A2 or notches A3 and A4. Furthermore, the cam pin 45 tracks that portion of the cam slot 24 which corresponds to the wishbone pattern W1 simultaneously with the wishbone pattern W2.

The second tool subassembly 40 has a generally large hollow through-bore 46 that provides a single flow path through the center of the tool 10 which, it is speculated, will create little or minimal flow restriction. Thus, the large through-bore 46 is adapted for higher flow rates with little restriction over known circulating tools.

Figure 7:
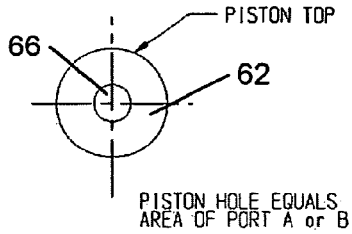
FIG. 7 illustrates a top view of the downhole circulating tool of FIG. 1.

The top end of the second tool subassembly 40 has coupled thereto a piston assembly 60. The piston assembly 60 includes a top flange 62 having a through-hole 66 (See, e.g., FIG. 7). The diameter of the through-hole 66 is smaller than the hollow through-bore 46 of the main tubular shaped structure 44. The top flange 62 also has a circumference wider than the circumference of the main tubular shaped structure 44 below which a piston spring 70 is helically wound around the exterior of the main tubular shaped structure 44. A first spring bearing 72A is positioned between the top end of the piston spring 70 and the underside of the top flange 62. A second spring bearing 72B is positioned between the lower end of the piston spring 70 and the top end of the tubular shaped structure 22 of the first tool subassembly 20. The piston flange 62 is coupled to the top end of the main tubular shaped structure 44 via a coupler 68 adapted to be received within the structure 44.

In one aspect, the bottom end of the main tubular shaped structure 44 has coupled thereto the lower seat 80 with the spring loaded valve 90. The seat 80 extends beyond the circumference of the main tubular shaped structure 44. The bottom end of the main tubular shaped structure 44 is constructed and arranged to support the spring loaded valve 90.

The spring loaded valve 90 includes a valve spring 92 and a valve plunger 94 (serving as a sealing ball) supported by valve support plate 86 positioned to one side (in the interior) of the main tubular shaped structure 44 while leaving the other side of the hollow interior unobstructed. The valve plunger 94 includes a shaft 99 having coupled to one end thereof a convexed head 98 contoured to be seated and seal a selective one of the openings to ports 102 and 104. In one aspect, the valve support plate 86 is perpendicularly coupled to a secondary plate 84 to form a generally L-shape. The secondary plate 84 serving as a baffle wall to isolate and close an opening 91B in the travel limiting plate 95 to the first port 102 or an opening 91A to the second port 104, as best seen in FIGS. 8A and 8B, respectively. The openings 91A and 91B in the travel limiting plate 95 are displaced approximately 180°. The openings are seats for the cradling of the convexed head 98. The valve support plate 86 reduces the size of the opening in the bottom of the main tubular shaped structure 44.

Furthermore, below the lower seat 80, two diametrically opposing sidewalls 88A and 88B are perpendicular to the seat 80.

The lower seat 80 includes a lower flange 82 having a circumference larger than the structure 44. Above the seat 80 are opposing openings or apertures 47A and 47B in the structure 44 which are positioned in proximity to flange 82.

The double-port connector 100 includes upper travel limiting plate 95. The travel limiting plate 95 engages sidewalls 88A and 88B. The double-port connector 100 includes a first port 102 which passes fluid downhole to the drill bit depending on the operation of the spring loaded valve 90. The opening 91B of the first port 102 is constructed and arranged to be closed or shut-off by the valve plunger 94 (serving as a sealing ball). The opening 91A of the second port 104 is open to allow fluid to pass out of the elongated outer sleeve 130. The double-port connector 100 is sealed via seals 106 to the interior circumferential surface of the elongated outer sleeve 130.

The seals of tool 10 are static and, it is speculated, will present very little problem or cause for failure. The locations of the notches of the cam slot 24 should be aligned with the openings in the travel limiting plate 95 (seats).

Figure 9:
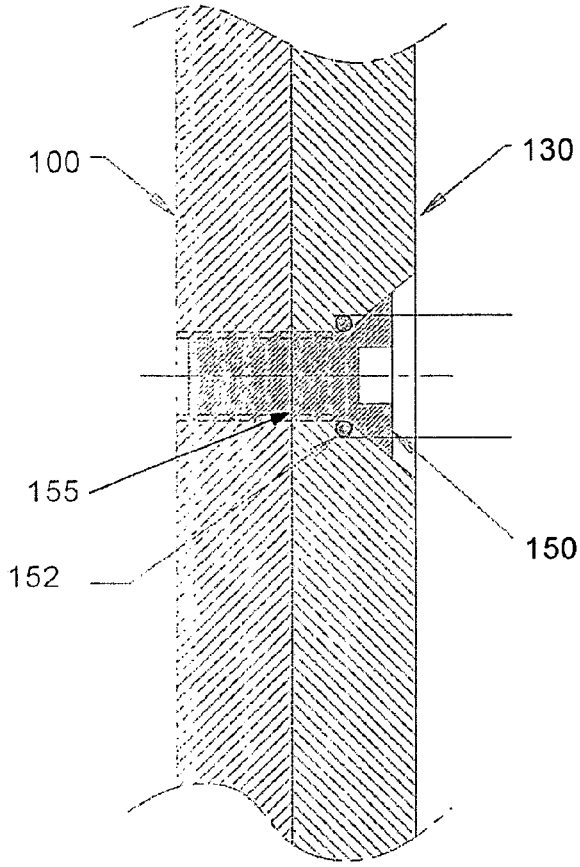
FIG. 9 illustrates a fastener connecting the double-port connector and an elongated outer sleeve.

FIG. 9 illustrates a fastener or screw 150 connecting the double-port connector 100 and the elongated outer sleeve 130. In one configuration, the screw 150 is a flat head screw. In one configuration, the screw 150 has an 82° degree counter sinking. An O-ring 152 seals the head of the screw 150 in a counter sunk bore 155 in the surface of the elongated outer sleeve 130. The bore 155 continues into the circumferential surface of the double port connector 100. The fastening described in FIG. 9 is also applied to the first tool subassembly 20.

As to FIG. 1A, in operation, assuming that the first port 102, of the double-port connector 100, is initially closed by the seating of the valve plunger 94 (i.e. sealing ball) into opening 91B and that the cam pin 45 is in a lower notch A3, the closing of first port 102 is accomplished, it is speculated, by compression of piston spring 70 by the force of the fluid, denoted by Arrow A, flowing down the work string and into circulating tool 10. Specifically, the force of the flowing fluid (Arrow A) pushes down on piston assembly 60, thereby, it is speculated, holding piston spring 70 in a compressed state such that subassembly 40 is moved toward the lower end of circulating tool 10, as shown in FIG. 1A, wherein first port 102 is closed by valve plunger 94, as noted above. To permit understanding, the cam pin 45 is shown in only one notch at a time (FIG. 2A). The valve plunger 94 is shown oriented to one side of the tool 10.

To begin to shift the valve plunger 94 from first port 102 to second port 104, the flow rate, and consequently the pressure, of the downward flowing fluid (Arrow A) is reduced at its source (at the top of the work string) such that, it is speculated, there is insufficient force applied to piston assembly 60 to hold piston spring 70 in a compressed state; subassembly 40 is consequently moved toward the upper end of the circulating tool 10 by the expansion of said piston spring 70. As subassembly 40 moves upward, cam pin 45 travels upward to one of the upper notches A2 and the second tool subassembly 40 automatically rotates and simultaneously lifts valve plunger 94 so that the ports 102 and 104 are both open, as best seen in FIG. 1B (wherein subassembly 40 is shown generally in a center of the tool 10).

To again force subassembly 40 to move toward the lower end of the tool 10, the pressure of the downward flowing fluid is again increased at its source until, it is speculated, sufficient force is applied to piston assembly 60 to again compress piston spring 70. As in FIG. 1C, as the cam pin 45 travels downward to a lower notch A4, the second tool subassembly 40 is automatically rotated and lowered. When the cam pin 45 reaches a lower point in notch A4, the second port 104 is closed by the seating of the valve plunger 94 in opening 91A.

It is speculated that the force applied to the top of piston assembly 60 by the downward flowing fluid (Arrow A) is determined by (1) the velocity of the downward flowing fluid, (2) the viscosity of said fluid, (3) the diameter of hole 66, and (4) the pre-load spring force applied by piston spring 70 which holds up subassembly 40. Circulating tool 10 is designed to "shift" (in other words, move from an upper position to a lower position while simultaneously rotating subassembly 40 ninety degrees (90°) relative to first tool subassembly 20) at certain fluid velocities for the viscosity of the fluid used, thus allowing operators at the top of the work string to shift the tool 10 from one port to another by adjusting the velocity and pressure of the fluid in the work string. It is further speculated that changes to the size of hole 66 will allow the customization of the amount of force required to shift the circulating tool 10 in any given situation. Thus, it is further speculated that the particular amount of fluid pressure required to shift the tool 10 will vary depending on the circumstances and variables discussed above.

The circulating tool 10 has no tube seals and is loosely fitted (sloppily fitted). The piston assembly 60 has a hole 66 therein and a fluid path through the center with little restriction. A higher flow rate is another advantage of the tool 10. A single fluid path through the tool's center is large enough to minimize restrictions. A simple ball (which in one configuration is a valve plunger 94) and seat combination is the only seal in the path of the fluid flowing through the tool 10. Even with some leakage the tool 10 will still function.

Although circulating tools may remove some drilling cuttings the primary use of the circulating tool 10 is to improve removal of caked drilling fluid, cement and debris from drilled casing plugs. It has been determined that most of this debris is attached to the casing wall.

Figure 10:
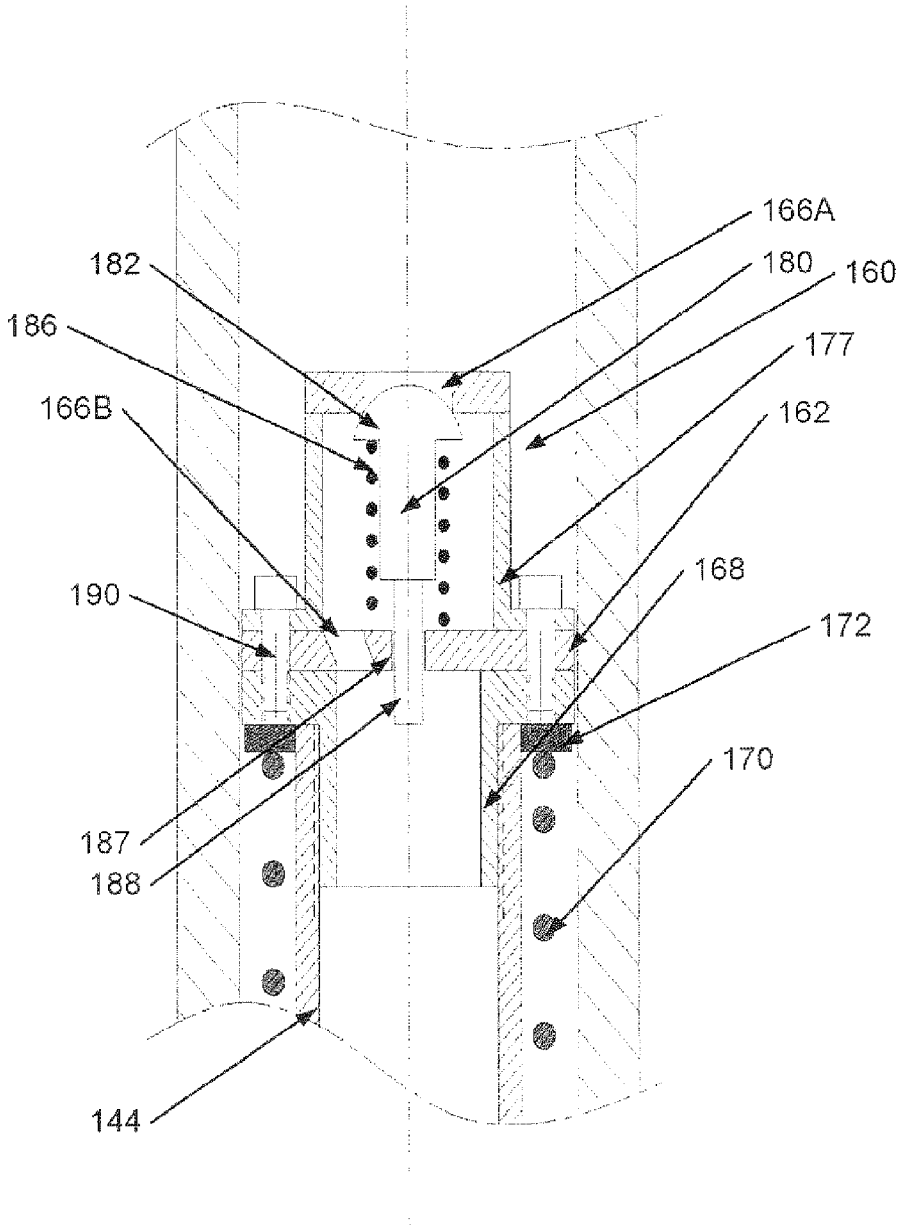
FIG. 10 illustrates an alternate embodiment of a top piston assembly.

FIG. 10 illustrates an alternate embodiment of a top piston assembly 160. The top piston assembly 160 is similar to the piston assembly 60. The piston assembly 160 includes a top flange 162 having a through-hole 1668 offset from a center through-hole 187. The top flange 162 also has fasteners 190 to fasten the top flange 162 to coupler 168. The top flange 162 also has a circumference wider than the circumference of the main tubular shaped structure 144 below which a piston spring 170 is helically wound around the exterior of the main tubular shaped structure 144. A first spring bearing 172A is positioned between the top end of the piston spring 170 and the underside of a flange coupled to the coupler 168.

The top piston assembly 160 further includes a spring-biased valve plunger 180 housed in housing 177. The top of the housing 177 has a through-hole 166A formed in a center thereof. The housing 177 is fastened to the top flange 162 via fasteners 190. The spring-biased valve plunger 180 is spring biased via spring 186 helically wound around shaft 188. The shaft 188 has a sealing ball (convex head) 182. The shaft 188 is slideably coupled in a center through-hole 187 in the top flange 162. In this embodiment, the spring strength of spring 186 is such that the tool 10 is able to shift or rotate before valve plunger 180 opens the through-hole 166A. This embodiment is for use with low flow and low pressure environments. As can be readily seen, the housing 177 may be readily installed or removed in the field.

Specifically, it is speculated that keeping through-hole 166A closed will allow sufficient pressure to build in the work string to shift tool 10 in a relatively low-pressure environment. It is further speculated that once tool 10 has shifted as a result of the downward force applied to piston assembly 160 (and the corresponding compression of piston spring 170 with the associated movement and rotation of subassembly 140), the pressure in the work string will continue to increase until said pressure reaches a point where the force of the downward flowing fluid is greater than the spring strength of spring 186, thereby compressing spring 186, lowering plunger 180 and opening through-hole 166A. It is further speculated that the opening of through-hole 166A will not reduce the pressure in the work string, and the corresponding force applied to piston assembly 160, enough to cause piston spring 170 to expand, thus causing the tool 10 to shift. Rather, it is speculated that a greater reduction in the pressure of the downward flowing fluid will be required to allow piston spring 170 to expand, thereby raising subassembly 140, and beginning the process of shifting tool 10 to another outlet port.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

What is claimed is:

1. A downhole circulating tool comprising:

a cam slot having wishbone patterns through which a cam pin moves;

first and second fluid port openings; and a sealing ball coupled to the cam pin to alternate opening and closing of the first and second fluid port openings as the cam pin travels in the cam slot.

2. The circulating tool according to claim 1, wherein the first port opening communicates fluid to a drill bit when open; and the second port opening communicates fluid directly into a borehole or casing wall of a wellbore when open.

3. The circulating tool according to claim 1, further comprising:

a main tubular structure configured to be coupled to a work string;

a sleeve concentric within and affixed to the main tubular structure, wherein said sleeve includes the cam slot; and a rotating assembly rotatably coupled to the main tubular structure and having a through-bore for communication of the fluid to the first and second fluid port openings, wherein the sealing ball is operable to be alternately seated in and to selectively close a respective one of the first and second port openings, as the rotating assembly rotates as the cam pin travels.

4. The circulating tool according to claim 3, wherein the cam pin moves simultaneously through the cam slot to rotate the rotating assembly at 90° increments.

5. The circulating tool according to claim 3, wherein the wishbone patterns have four notches spaced circumferentially 90° apart and arranged to alternate the closing of the first and second port openings after the rotating assembly rotates 180°.

6. The circulating tool according to claim 5, wherein when the cam pin is in a first position, the first port opening is closed, as the cam pin travels upward to a second position, the rotating assembly rotates and the sealing ball is lifted to open the first port opening; and as the cam pin travels downward to a third position, the rotating assembly rotates and the sealing ball is lowered to close the second port opening.

7. The circulating tool according to claim 3, further comprising top and bottom connectors configured to connect the main tubular structure to a work string.

8. The circulating tool according to claim 3 wherein the cam pin travels in the cam slot in only one circumferential direction.

9. The circulating tool according to claim 1, wherein the cam pin is configured to move from a first upper position to a first lower position of the wishbone patterns while simultaneously rotating 90°, and from the first lower position to a second upper position of the wishbone patterns while simultaneously rotating 90° and from the second upper position to a second lower position of the wishbone patterns where the sealing ball is seated in the first port opening when the cam pin is in the first lower position and in the second port opening when the cam pin is in the second lower position.

10. A downhole circulating tool comprising:

a main tubular structure configured to be coupled to a work string;

a sleeve concentric within and affixed to the main tubular structure, the sleeve including a cam slot;

dual-port openings coupled in the main tubular structure, wherein a first port opening passes fluid through a portion of the work string below the dual-port openings and a second port opening passes fluid into a borehole; and a rotating assembly rotatably coupled in the main tubular structure and having a through-bore for communication of the fluid to the dual port openings, a cam pin and a sealing ball configured to be alternately seated in and to selectively close a respective one of the first and second port openings, wherein the rotating assembly rotates as the cam pin travels in a generally symmetrical cam slot.

11. The circulating tool according to claim 10, wherein the cam pin moves simultaneously through symmetrical portions of the cam slot to rotate the rotating assembly at 90° increments.

12. The circulating tool according to claim 10, wherein the cam slot has a pair of wishbone patterns having four notches spaced circumferentially 90° apart and arranged to alternate closing of the first and second port openings after the rotating assembly rotates 180°.

13. The circulating tool according to claim 12, wherein when the cam pin is in a first position, the first port opening is closed; as the cam pin travels upward to a second position, the rotating assembly rotates and the sealing ball is lifted to open the first port opening; and as the cam pin travels downward to a third position, the rotating assembly rotates and the sealing ball is lowered to close the second port opening.

14. The circulating tool according to claim 10, further comprising top and bottom connectors configured to connect the main tubular structure to a work string.

15. The circulating tool according to claim 10, wherein the cam pin is configured to move from a first upper position to a first lower position of the symmetrical cam slot while simultaneously rotating 90°, and from the first lower position to a second upper position of the symmetrical cam slot while simultaneously rotating 90° and from the second upper position to a second lower position of the symmetrical cam slot where the sealing ball is seated in the first port opening when the cam pin is in the first lower position and in the second port opening when the cam pin is in the second lower position.

* * * * *